US007543790B2

(12) United States Patent
Starcher

(10) Patent No.: US 7,543,790 B2
(45) Date of Patent: Jun. 9, 2009

(54) MULTIPLE CONFIGURATION PORTABLE EASEL

(76) Inventor: Will Andrew Starcher, 25 Scaffold Run, Spencer, WV (US) 25276

( * ) Notice: Subject to any disclaimer, the term of this patent is extended or adjusted under 35 U.S.C. 154(b) by 253 days.

(21) Appl. No.: 11/396,822

(22) Filed: Apr. 3, 2006

(65) Prior Publication Data

US 2007/0228246 A1 Oct. 4, 2007

(51) Int. Cl.
*A47B 97/04* (2006.01)

(52) U.S. Cl. ..... 248/460; 248/461; 248/462; 248/463; 248/441.1; 248/464; 248/163.1; 248/188.6

(58) Field of Classification Search ..... 248/460, 248/441.1, 458, 461, 462, 463, 464, 465, 248/163.1, 434, 439, 150, 149, 165, 166, 248/447, 176.1, 125.9, 121, 122.1, 124.1
See application file for complete search history.

(56) References Cited

U.S. PATENT DOCUMENTS 2,046,134 A * 6/1936 Ryang ..... 248/461
3,145,966 A * 8/1964 Landon ..... 248/464
4,017,152 A * 4/1977 Allen ..... 359/443
4,266,748 A * 5/1981 Dalton ..... 248/425
4,355,779 A * 10/1982 Heled ..... 248/460
5,829,178 A * 11/1998 Hillstrom ..... 40/610
6,056,273 A * 5/2000 Smith ..... 254/266
6,572,061 B2 * 6/2003 Overbeck ..... 248/188.6
6,606,809 B2 * 8/2003 Hillstrom et al. ..... 40/610
7,236,695 B1 * 6/2007 Demos ..... 396/3
7,293,753 B1 * 11/2007 Kapp ..... 248/464

* cited by examiner

*Primary Examiner*—J. Allen Shriver
*Assistant Examiner*—Todd M. Epps
(74) *Attorney, Agent, or Firm*—Waters Law Group, PLLC; Olen L. York, III

(57) ABSTRACT

Improved portable easel (10) comprising two functional sections, base (12) and arm holder (16) fastened together with locking hinge mechanism (14) formed by adjustable clutches (14A,14B). The arm holder comprises a plurality of members with an elbow-shaped bend (52A, 52B), containing a plurality of openings in the distal end attached to the hinge mechanism (14) and a plurality of openings in the proximal end, such that proximal openings are at right angles. This hinge mechanism permits the curved holder to fold down over the base and the legs for compact storage and up for a range of angles. Adjustable length arms (22) are attached to arm holder with adjustable clutches (18), allowing arms to freely pivot in a plane until locked in position. Adjustable support legs (20) are pivotally fastened within angled cutouts (42) in the base. Sliding, adjustable, artwork holders (24) are attached to the arms with adjustable clamps.

14 Claims, 11 Drawing Sheets

MULTIPLE CONFIGURATION PORTABLE EASEL

This application claims priority to provisional application 60/667,865 filed Apr. 1, 2005.

FEDERALLY SPONSORED RESEARCH

Not applicable

SEQUENCE LISTING OR PROGRAM

Not applicable

BACKGROUND

1. Field of the Invention

The present invention relates to a portable, adjustable easel. More particularly, this invention relates to a portable, easel that adjusts to multiple configurations and provides maximum degree of stability and adjustability to hold an expanded range of canvas sizes and shapes.

2. Description of Prior Art

Portable Easels

Easels are commonly used by artists to hold canvasses, pads of paper and/or drawing boards while works of art are being made. Easels are also used to hold completed artworks, including framed artworks, and other planar objects for display. The majority of easels are designed to be portable and adjustable to some degree. However, portable easels are not always easily transportable by collapsing into a small format that is easy to carry and/or ship.

Artists and others who use easels for display purposes desire an easel that is lightweight and collapsible for transportation and that quickly and easily sets up indoors or out for holding canvasses, displays and other artworks. They also desire an easel that can hold planar artworks of different dimensions, shapes and materials. Artists also desire an easel that holds a planar artwork in a stable position so that it does not shift when the artist is applying paints or drawing on it. Artists also desire an easel that holds an artwork in a range of positions for easy access to apply a variety of paints or other art materials to its surface. Such an adjustable easel will allow the artist to sit or stand when working and to view the artwork from a convenient position during its creation.

Portable adjustable easels are manufactured from wood, metal or composites. Portable easels typically range in weight from 1.5 pounds to 15 pounds. Portable adjustable easels hold canvasses in a variety of manners. Most commonly, a tray protrudes from the tripod easel to support the canvas from the bottom, such that the top of the canvas simply reclines against the easel stand. Most have a clamping member for accepting the top edge of an artwork, preventing the artwork from falling off the tray.

Tripod Easels

A common type of portable easel is a folding tripod easel. Tripod easels can adjust the height of the artwork by adjustable legs. The upright tripod base tends to be unstable, and tips over easily when the wind catches a painting like a sail in outdoors use. This type of easel is most often used to hold or display smaller canvasses ranging from 4 inches by 6 inches to 18 inches by 24 inches. The easel legs often use pivotal tie-bars, or braces that fold down, to stabilize the legs. The tripod easel can also be equipped with chains to keep the legs from folding out too far to an unstable angle. The tripod easel typically uses the rear leg as the method of adjusting the angle of the canvas from leaning away from the artist toward the vertical, the preferred view for painting. The closer the canvas is to vertical, the more the rear leg must be drawn to the front legs, making the easel less stable and more likely to tip over. Therefore, an improved system for adjusting the angle of an artwork and stabilizing the base is needed for folding metal tripod easels.

An improved portable tripod easel has been described by Kappa US 2003/0193004 A1, Oct. 16, 2003. This easel uses a central spine brace to provide stability for the tripod. This easel also uses the central spine brace to hold the painting in a stable vertical position. A disadvantage for this easel is that the central spine brace interferes with an artist working close to the artwork from a seated position. A second disadvantage is the limited capability for the user to adjust the angle of the painting to a position that is horizontal with respect to the ground for watercolor painting. This easel is also limited in the size and shape of the object to be painted or displayed.

Paint Box Easels

Another common type of portable easel is the paint box easel, often termed a French easel. These easels typically consist of a wooden box with a hinged lid. Two front legs are pivotally affixed to the front of box. A back leg is pivotally attached to the back of the paint box. The hinged lid can be opened and stood up to hold a canvas, and devices can be used adjust the angle of the canvas. A disadvantage of all paint box type easels is that they are heavy, typically weighing over 12 pounds. This easel is not intended for seated artists to use while painting, since the rear leg of the easel interferes with the ability of the seated artist to sit close to the painting.

Graybill [U.S. Pat. No. 5,833,201] has developed an improved example of a collapsible paint box easel. This easel uses a mechanism to slide the hinged lid to the side, away from the box, so that the painter doesn't need to lean over the paint box. This easel also uses an improved system to adjust the height of the legs. This easel can also hold a much larger range of paintings, ranging from 4 inches by 6 inches to 18 inches by 24 inches. A limitation to this easel type is that it is designed solely for outdoor painting and is not useful in the studio or to display objects. Even this improved easel is bulky and it doesn't fold compactly for transport.

Easels for Seated Painters

Several easels have been described to address the need for the artist to paint from a seated position. The need for an adjustable easel that meets the need for a limited mobility artist, especially one who must work while seated in a wheelchair, has been considered in the development of artist's easels. Sterling et al. [U.S. Pat. No. 5,074,513] describe an easel for use by a seated artist. This easel holds an artwork between two adjustable boards. This artwork holder can rotate in a circular plane to move the artwork to different angles by use of a crank. This easel is not designed to be collapsible and is not intended for use on surfaces that are not level. Although a work held by the easel can be rotated to convenient positions, the artwork cannot be positioned to make a horizontal surface with regard to the ground for watercolor work. This easel is limited in the size of artwork that can be accommodated and is not intended for use by a standing artist.

Although prior art easels recognize and seek to address in part the deficiencies we have identified in portable artists' easels, these prior art easels fail to offer our comprehensive approach to completely rethink the portable easel for improved performance and versatility. In particular, a portable easel that easily adjusts the position of the artwork during painting is desirable. While there are many easels that allow some degree of adjusting the position of a canvas that they hold, none of them provides ability to position the painting in multiple directions that the artist requires. Also, the stability of a tripod easel is not satisfactory. The easel assembly of the present invention overcomes the multiple disadvantages of prior portable easel assemblies.

Operation of the Easel

The easel comprises two functional sections which are fastened together. The lower section comprises at least four legs, which can be fixed in a closed or open position. The legs are pivotally attached to the base. The legs can be attached to the base by tension pins or bolted into the base. In the preferred embodiment, the legs fit into slots, openings or angled cutouts that are machined out of the solid aluminum base and are rotationally fixed by of tension pins. The legs are moveable between inward folded position(s) and outward, extended, support position(s). A range of other fastener types will work to hold the legs to the base provided the fasteners allow lateral rotational movement of the legs. When the legs are in the closed position, they move closer together, and the legs are positioned at a 90-degree angle relative to the base. When the legs are fixed in the open position, they are rigidly braced at a suitable angle within the cutout. The legs and the base form an abutment and spread the compressive force of the base and the rest of the easel downward. This forms a stable central base for the easel. Stability is essential in any easel, especially in one designed to hold a range of sizes and weights of artworks. Stability is also required in a portable easel, which must be set up in a variety of environments. The legs are held in the extended position by the force of the heavy artwork on the base. This force is spread through the base and down through the legs, which forces the legs to remain in an abutted position within the angled cutouts. The legs may be braced open by insertion of a locking mechanism.

Stable Adjustable Easel Base

The base in this embodiment is shaped like a K, with the straight edge of the K in front and the V-shaped portion of the K in back. The K-base has a central block joined to four projecting rectangular leg supports. The sharp angles of these rectangles can be removed by machining for appearance and safety. The two front leg supports are located on either side of a central block. The two back leg supports project at mirror image angles from the central block. The two front legs of the easel are fastened to the front leg supports in such a way that they project laterally at an angle. This permits larger artworks to be held by the easel in a vertical or tilted forward position without interference with the legs. The easel's rear legs are fastened to the rear leg supports such that the rear legs project at mirror image angles in the V-shaped portion of the K-base. This provides more stable weight distribution.

The angles in the cutouts for all the legs can be identical, which is preferable for the broadest range of arm holder positions. The angles of the cutouts for the rear legs can be slightly more obtuse than those of the front legs, which tilts the base of the easel to a slight angle of 1 to 30 degrees. This offsets the force of heavier paintings on the front of the easel held by the arm holder in the vertical position. This design permits the artist to extend their legs under the base when they are painting in the seated position. The K shaped base also permits less material to be used in construction, reducing weight, cost and size. The rear base may be formed in modified versions of this configuration in a manner consistent with these design goals.

Each leg is adjustable in length. In one preferred embodiment, legs are telescoping outer and inner tubes that can be adjusted between extended and retracted lengths to move the easel to a variety of heights. These legs permit base height to be adjusted in convenient increments of 1-3 inches and are kept in position with by a variety of locking mechanisms, including but limited to split collar wing knob leg locks, locking spring button push pins, or adjustable annular clutch locks. It is understood that other leg designs that permit a stable, lightweight, strong, extendable leg configuration, such as folding shock cord legs, would also be suitable for use in this easel. A plurality of telescoping tubing shapes (circular, rectangular, hexagonal) may be used for these legs provided the cutouts in the K shaped base are modified to accommodate them. The largest diameter of the telescoping tubing in the legs is one which can be fastened within the cutouts in the K-base.

The feet can include a steel or carbide spike for outdoors use with a protective, non-slip plastic or rubber foot covers for use inside. The feet will be have screw-on plastic or rubber dome baskets similar to those used for hiking or skiing poles. These baskets prevent the legs from sinking too far into soft earth or sand. It is understood that other mechanisms exist to serve the function of staking the easel legs into the ground to provide stability for outdoor painting such as leg spikes and could be used in some embodiments of the easel. Leveling glides may also be substituted for spikes for indoor use.

Positioning Artworks

The upper section comprises an element (the H holder) designed to hold a plurality of adjustable arms. The H-holder comprises two curved members joined by a straight cross-secting member. It is understood that the H-holder could be a solid piece with this profile rather than three individual joined members. This element is attached to the K shaped base using adjustable radial clutches at the two curved members. These adjustable radial clutches are available commercially for use in lighting fixtures and musical equipment. The adjustable radial clutches contain a plurality of interlocking teeth held together by a screw tightened with a wing nut or circular knob. One such brand is the Posi-lok clutch. It is understood that other adjustable radial clutches will also serve this purpose.

The clutches are fastened to the K base and the H-holder using a plurality of fasteners, including but not limited to bolts, rivets, compression fasteners or welds. The adjustable radial clutches permit the H-holder to become an adjustable hinge mechanism that can be positioned and locked in place. This hinge can be manipulated to position artwork from a flat, table top position to a vertical position to a tilted forward position. The flat table position is preferred for watercolors and drawings. The vertical position is preferred for oil and acrylic paintings. The tilted forward position is preferred for charcoal or pastel work, since it prevents the particles from falling on the work in progress or for reducing glare from wet surfaces during painting. Unlike the prior art, the radial clutch locks permit this hinge mechanism to be rigidly locked rather than held in place by compression alone. This mechanism also is robust and can accommodate heavier artwork than other lightweight portable easels. This hinge mechanism permits the curved H-holder to fold down over the K-base and the legs for compact storage.

The straight portion of the H-holder receives four additional radial clutch locks which in turn are attached to four adjustable, telescoping arms. This is accomplished using a plurality of fasteners, including but not limited to bolts, rivets, compression fasteners or welds. One radial clutch is fastened to each of the four ends of the H-holder in a plane. These four radial clutch locks permit each of the four arms to be individually moved in a 200 degree radius within this plane. When the arms are moved using the radial clutch fasteners, these arms form a flat surface upon which the artwork can be held in place using J-shaped clamping members which can be selectively moved along the telescoping arms. In accordance with one aspect of this invention, the clutches enables the arms to swing out to hold nonrectangular paintings and to position rectangular paintings on the diagonal. In conjunction with the hinge function of the H-holder, the adjustable arms can be positioned to hold the artwork in an ergonomic position, so that fatigue, strain and injury from repetitive motion at an uncomfortable height or angle can be minimized. The adjustable arms provide an increased display surface where up to four artworks can be accessed with a variety of orientations in the X, Y and Z planes. In terms of three-dimensional motion, the artwork can be adjusted to have pitch or roll but not yaw.

The arms are telescoping outer and inner tubes which can be adjusted to extend the arms to a variety of lengths. These arms can be adjusted in convenient increments of 1-3 inches and are kept in position with by a variety of locking mechanisms, including but limited to split collar wing knob leg locks, locking spring button push pins, or adjustable annular clutch locks. It is understood that other arm designs that permit a stable, lightweight, strong, extendable configuration, such as folding shock cord arms, would also be suitable for use in this easel. A plurality of telescoping tubing shapes (circular, rectangular, hexagonal) can be used for these arms, provided the H-holder is modified to accommodate them. The smallest diameter of these telescoping tube arms is fastened to the radial clutch and the largest diameter extends outward. This is preferable, since this permits the use of a single diameter J-shaped clamping member to for both large and small artworks.

Holding Artworks

One J-shaped assembly 24, (one for each arm 22) serves as a secure attachment device for the artwork. This assembly is best illustrated in FIG. 8B. The J-shaped assembly 24 comprises three elements: a flat piece of material 40C (such as metal or composite) bent in the profile of the letter J; a flat, rectangular piece of material 34C to which the J-shaped element is fastened with a rivet or other fastener which permits rotational movement of the J-element 40C; and an adjustable fastener 36C attached to the flat, rectangular piece of material 34C, which can be positioned along the extendable arm to hold varying sizes and shapes of artwork.

The J-shaped assemblies 24 are designed to stably hold the artwork close to the supporting arms 22 of the easel 10 by directing the force of the artwork to press the J-shaped member 40C against the flat rectangular member. In this embodiment, the J-shaped member uses friction to stabilize the heavy artwork on the light weight easel. The J-holder can be covered by a plastic sleeve, which provides a flat, grooved surface to hold thinner boards such as Masonite boards. It is readily evident to one skilled in the art that other adjustable holder and clamp systems may also be used to affix artworks to the easel. The folded easel then fits within a storage bag. It is collapsible without disassembly of the arms, legs or painting supports from the base and arm holder.

Objects and Advantages

Accordingly, besides the objects and advantages of the multiple configuration portable easel described in my above patent, several objects and advantages of the present invention are:

This is an adjustable easel, which can provide full degree of freedom, stable and convenient operation of canvas position adjustment, compact size and portability, and versatile storage space. The easel assembly of the present invention overcomes the disadvantages of prior portable easels. It is lightweight and compact for easy storage, yet can be easily unfolded for use in a variety of positions.

This portable easel can hold both rectangular and nonrectangular artworks using adjustable arms with gripping device(s) that adjust to hold the artworks securely. The arms can positioned using radial clutch fasteners, which permit each arm to move up to 200 degrees in a plane. This permits nonrectangular artworks to be held securely. It also permits positioning rectangular artworks on the diagonal for ease of painting.

The arms are attached to the base of the easel with a hinge mechanism, allowing the user to tilt the artwork to the desired position and secure that position rigidly in place. This arm and gripping device system permits the user to paint several paintings together using a single easel. This lightweight, portable, adjustable easel can be manipulated to position artwork from a flat, table top position to a vertical position to a tilted forward position for improved performance and versatility of painting and drawing with different media. This lightweight, portable, adjustable easel allows the user to position themselves close to the canvas on a chair without interference from the easel legs and/or braces. Use of a central base, with four legs held in position with an angled slot, is more stable than a tripod ease. The height can be adjusted by extending or retracting the adjustable legs.

Other features and advantages of the present invention will become apparent from the following detailed description, taken in conjunction with the accompanying drawings, which illustrate, by way of example, the principles of the invention.

SUMMARY OF THE INVENTION

This invention relates to an improved portable easel that can be adjusted to multiple positions so that artists can work in both seated and standing positions. The easel provides the maximum degree of stability and adjustability and holds an expanded range of canvas sizes and shapes.

DRAWING FIGURES

FIG. 10 A is a front view of the H-holder positioned over the K-base in the most vertical position without the arms and legs.

Figure 10A:
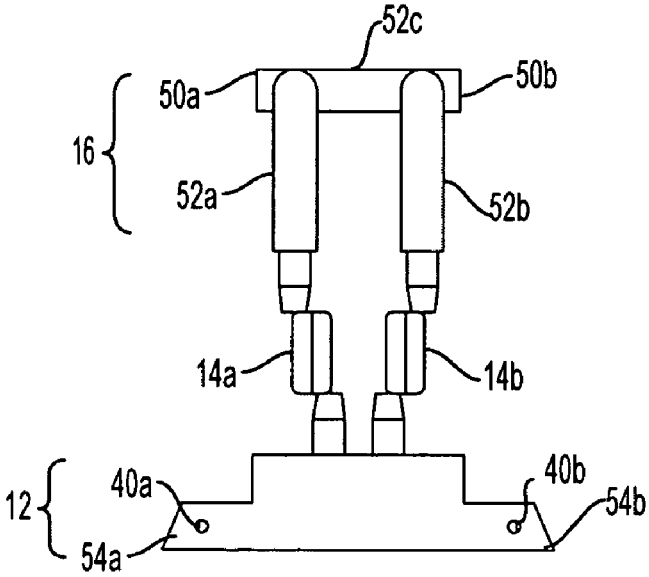
Figure 10B:
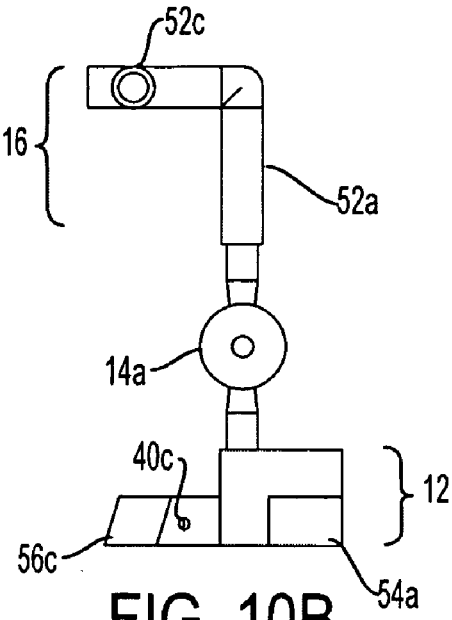

FIG. 10B is a side view of the H-holder positioned over the K-base in the most vertical position without the arms and legs.

Figure 10C:
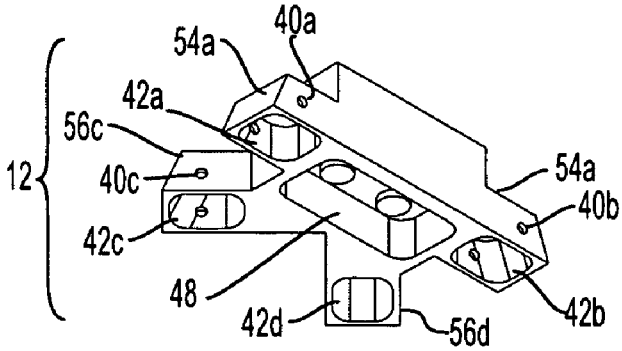

FIG. 10C is a perspective view of the K-base from the bottom, illustrating the angled cutouts into which the legs will be inserted with tension pins.

Figure 10D:
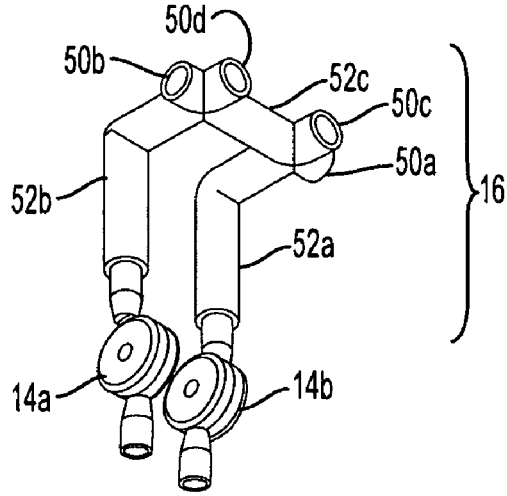

FIG. 10D is a perspective view of the H-holder illustrating the curve of the H-holder and four empty positions into which the radial clutch locks for the adjustable arms will be inserted.

Figure 11:
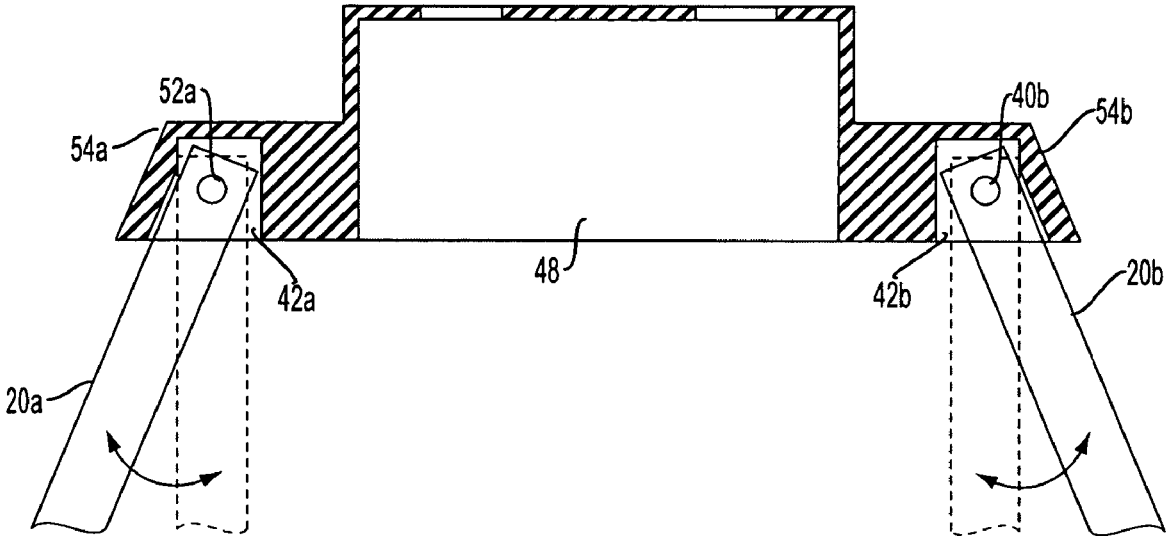

FIG. 11 is a front view of the K-base indicating the positions of the cutouts into which the legs and the H-holder fasteners will be inserted.

REFERENCE NUMERALS IN DRAWINGS

10 Easel
12 K-base
14 Hinge Mechanism
16 H-holder
18 Adjustable Clutches
20 Adjustable support legs
22 Adjustable arms
24 J-holder
26 Annular arm clamp
28 Annular leg clamp
30 Domed baskets
32 Rubber foot covers
34 Flat piece of metal
36 Artwork holder clamp
38 Rivet
40 Tension pin
42 Leg Cutouts
44 J shaped piece of metal
48 Base cutouts
50 H-holder openings
52 Tubes
54 Front rectangular leg supports
56 Back rectangular leg supports
58 Raised Central Block of K-base
60 Flat front face of K-base
62 First leg extension
64 Second leg extension
66 Second arm extension
68 First arm extension

DETAILED DESCRIPTION OF THE INVENTION

Description-Easel System

FIGS. 1-11 discloses an improved easel 10 in accordance with the present invention. The preferred embodiment of the present invention is described below where specific terminology will be resorted to for the sake of clarity. However the invention is not intended to be limited to the specific terms so selected and it is to be understood that each specific term includes all technical equivalents which operate in a similar manner to accomplish a similar purpose. With reference to the accompanying drawings, the present invention is a novel lightweight, portable, collapsible Easel 10. Easel 10 includes a K-base 12, a plurality of adjustable support legs 20, attached with a tension pin 40, an H-holder 16, with an attached hinge mechanism 14, and a plurality of openings 50 for insertion of a plurality of adjustable clutches 18. Adjustable clutches 18 are attached to an adjustable arm 22. A sliding, adjustable, J-holder 24 is attached to arm 22 with an adjustable artwork holder clamp, 36.

In accordance with the invention, easel 10 comprises two functional sections, K-base 12 and H-holder 16 which are fastened together with an adjustable hinge mechanism 14. In the preferred embodiment, this adjustable hinge mechanism 14 comprises two adjustable clutches 14A and 14B. This connection is best seen in FIGS. 6, 7, 9, 10A and B. In the preferred embodiment, two adjustable clutches 14A and 14B are bolted through a cutout area 48 of K-base 12 or attached by other conventional attachments. This is best seen in FIGS. 10C and 11. In the preferred embodiment, hinge mechanism 14 operates by loosening adjustable clutches 14A and 14B so that H holder 16 can swing from an open position in FIG. 7 to a closed position in FIG.8B for storage and transportation.

Description: Base of Easel

Figure 9:
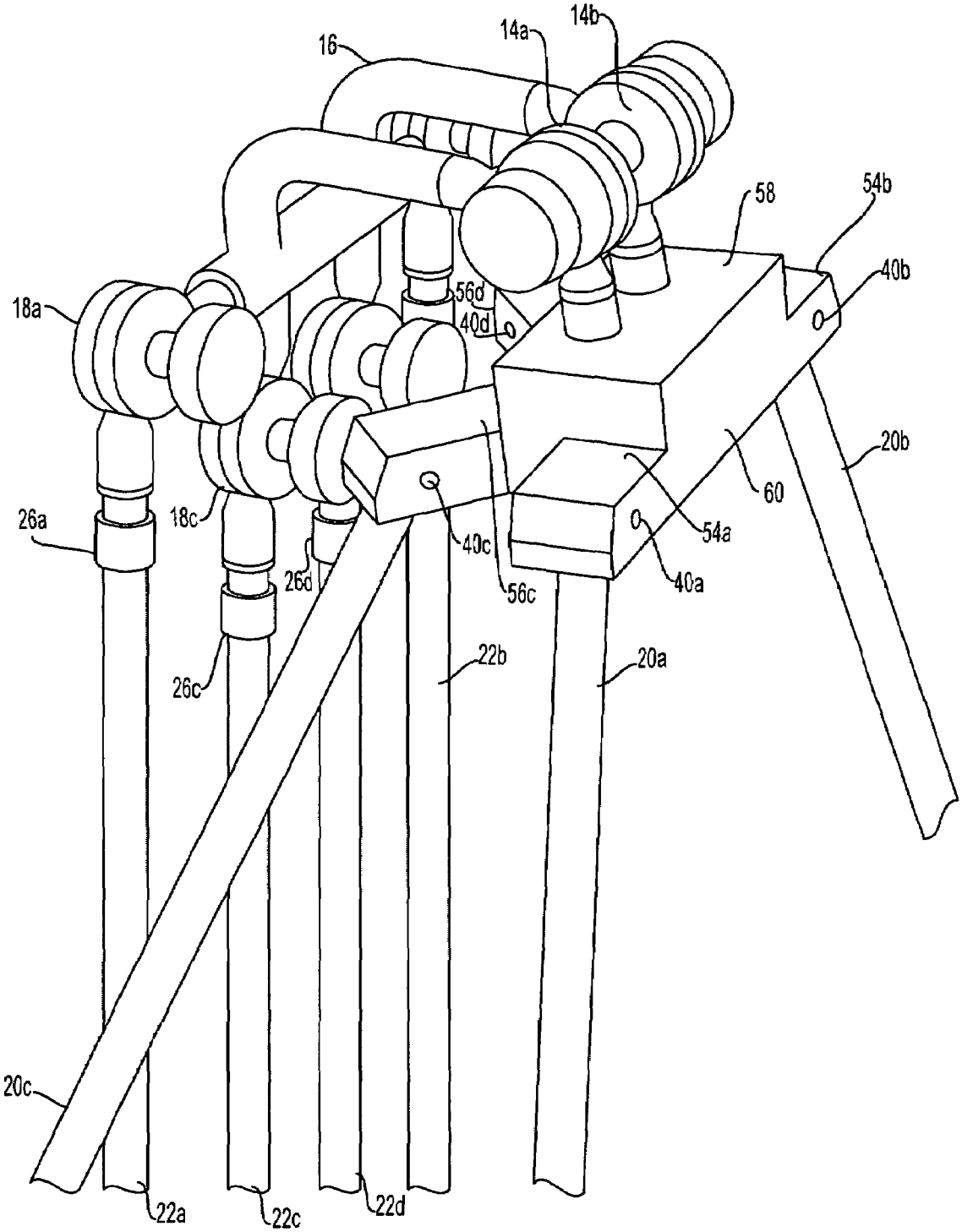
FIG. 9 is perspective view of the H-holder and K-base assembly with the H-holder folded over the K-base and the legs in the unfolded position in the K-base.

As can be seen, in the preferred embodiment, K-base 12 forms a stable base for easel 10. K-base 12 has been formed in the approximate shape of the letter K as best seen in FIG. 9. In the preferred embodiment, K-base was machined from a solid block of aluminum. An aluminum block was cut down to have a flat front face 60. A raised central block 58 was manufactured by cutting away excess metal from the original solid block. K-base 12 has raised central block 58 joined to a plurality of projecting, roughly rectangular, leg supports 54A, 54B, 56C and 56D. Sharp angles have been removed from leg supports by machining for appearance and safety. Front leg supports 54 are located on either side of central block 58. Two back leg supports 56 project at mirror image angles from raised central block 58.

Figure 2:
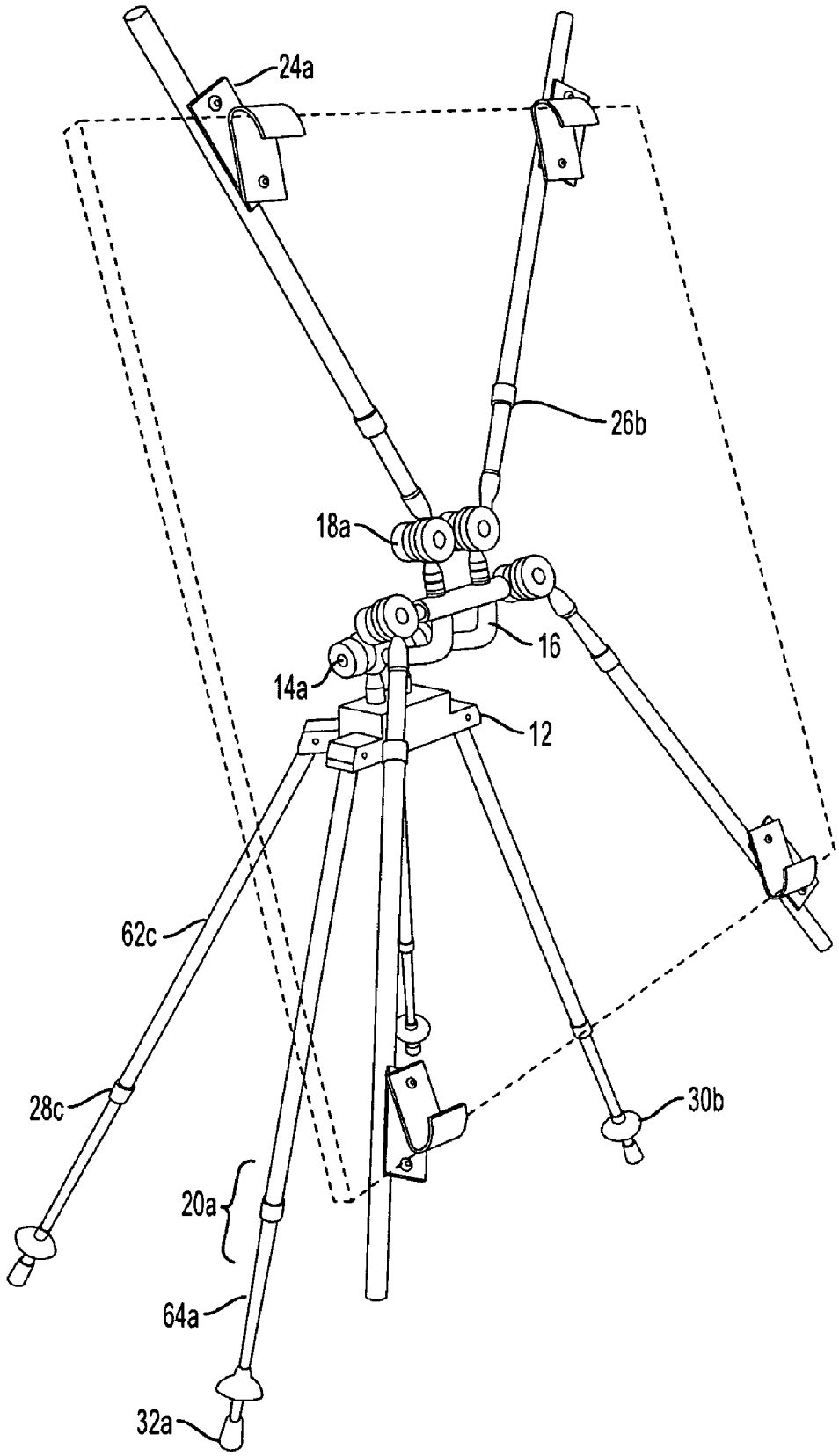
FIG. 2 is a perspective view of the partially extended easel holding a rectangular artwork.

In the preferred embodiment, there is a cutout 42 in front leg support 54 and in rear leg support 56. These cutouts 42 are hollowed out of the bottom face of the solid metal K-base 12, best seen in FIG. 10C. In the preferred embodiment, legs 20 are fastened through tension pins 40 into holes drilled in K-base 12 to allow maximum width and stability. It is understood by one skilled in the art that a variety of fasteners will allow each leg 20 to pivot from a position where legs 20 are aligned side by side to a position where legs 20 are spread laterally. The width of spread legs enables an artist to work while seated. FIG. 2 illustrates easel 10 holding a rectangular artwork.

Two front legs 20A and 20B are fastened to front leg supports 54A and 54B in such a way that legs 20A and 20B project laterally in the first plane of direction. Two back legs 20C and 20D are fastened to rear leg supports 56A and 56B in such a way that rear legs 20C and 20D project at an angle from raised central block 58. These cutouts 42C and 42D are angled such that rear legs 20C and 20D project to rear of easel 10 in a slightly more obtuse angle than the angle of front legs 20A and 20B. This tilts K-base 12 of easel 10 to a slight angle. This stabilizes heavier paintings on the front of easel 10. K shaped base 12 permits less material to be used in construction, reducing weight, and size.

In accordance with the invention, support legs 20 are pivotally connected to K-base 12 by at least one tension pin 40A. In the preferred embodiment, each leg 20 is individually adjustable in length. This permits easel 10 to be set up on uneven surfaces. Each leg 20 comprises a first extension 62 and a second extension 64 slidably connected to one another. Second extension 64 has at least a portion thereof slidably received in the open-faced channel of first extension 62. Second extension 64 is secured in position with a clamp 28 extending from second extension 64 through a slot of first extension 62. In the preferred embodiment, the maximum telescoping length of legs 20 is 36 inches. In the preferred embodiment, the maximum diameter of the leg tubing is 1 inch.

Figure 7:
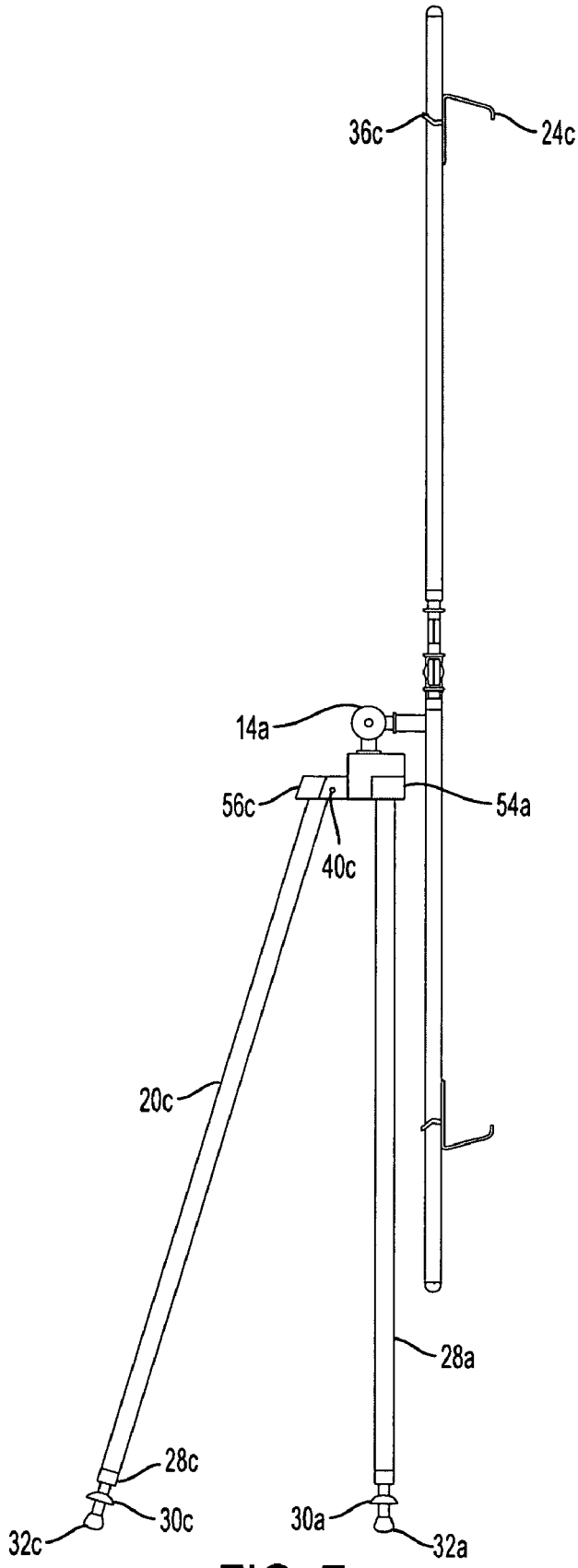
FIG. 7 is a side view illustrating that the rear legs of the easel can be fastened to the K-base in a cutout angled to the back of the K-base while the front legs can be fastened to the K-base in a cutout angled to the sides of the K-base.
Figure 8A:
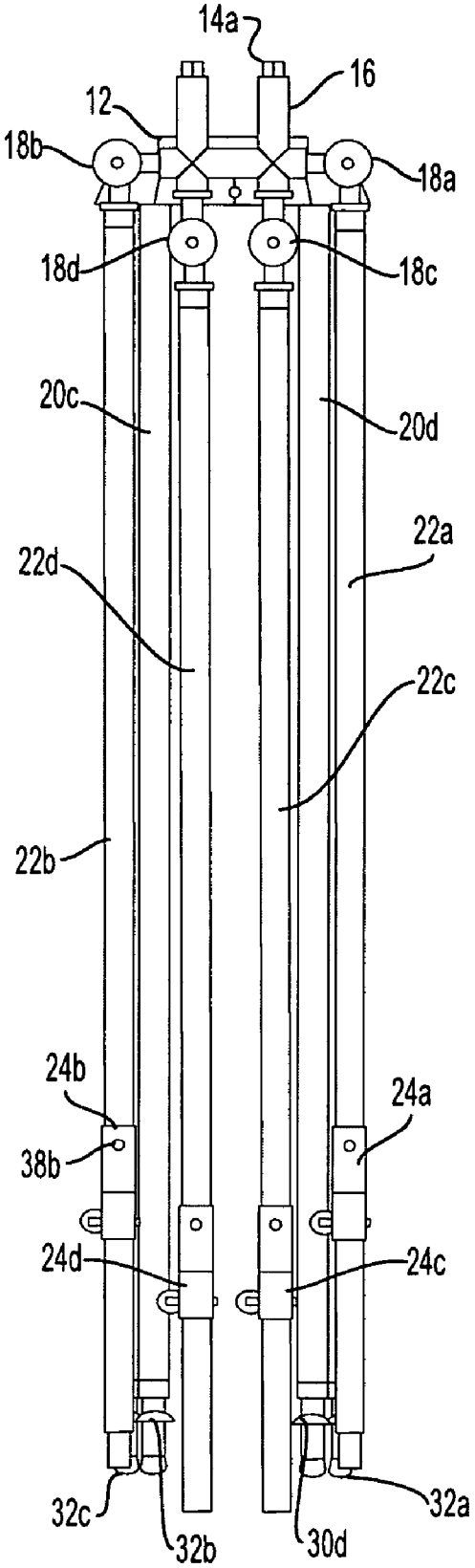
FIG. 8A is a back view of the folded easel, showing that the H-holder folds over the K-base using an adjustable hinge formed by the radial clutch lock.
Figure 8B:
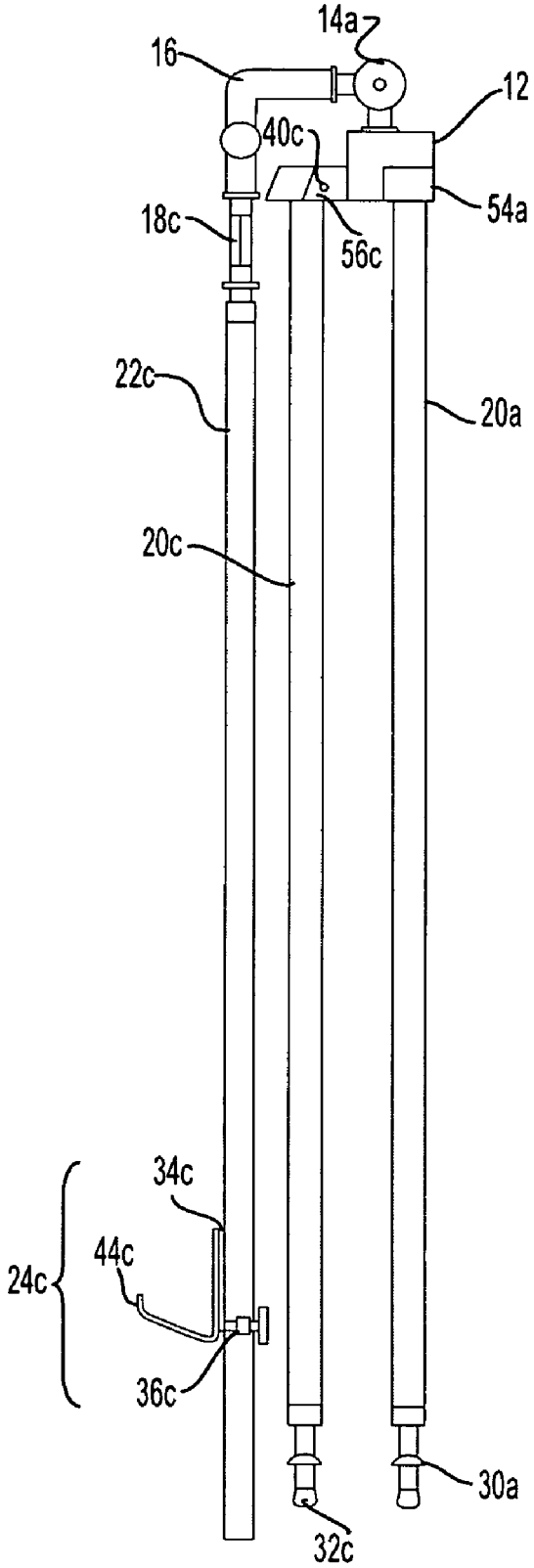
FIG. 8B is a side view of the folded easel, showing that the H-holder folds over the K-base using an adjustable hinge formed by the radial clutch lock and illustrating the relationship between the three parts of the J-holder.

The angles in cutouts 42 for all legs 20 can be identical, which is preferable for the broadest range of H-holder 16 positions, as adjusted by hinge 14. Cutout 42 comprises a first open end directed generally transverse or angled to a plane of the base and a second open end directed generally parallel to the plane of the base as seen in FIG.10C and FIG. 11. Legs 20 are movable from a folded and supportive position in which leg 20 extends through the second open end of cutout 42, to an unfolded and supportive position wherein leg 20 extends to first transverse end of cutout 42. This is best seen in FIG. 7 and FIG. 8B.

The angles of the transverse ends of cutouts 42C and D for rear legs 56A and 56B can be slightly more obtuse than those of front legs 20A and 20B. This configuration tilts K-base 12 of easel 10 to a slight angle of 1 to 30 degrees. This tilt offsets the force of heavier paintings on the front of the easel held by the arm holder in the vertical position. This design permits the artist to extend their legs under the base when they are painting in the seated position. K shaped base 12 also permits less material to be used in construction, reducing weight, cost and size.

Figure 1:
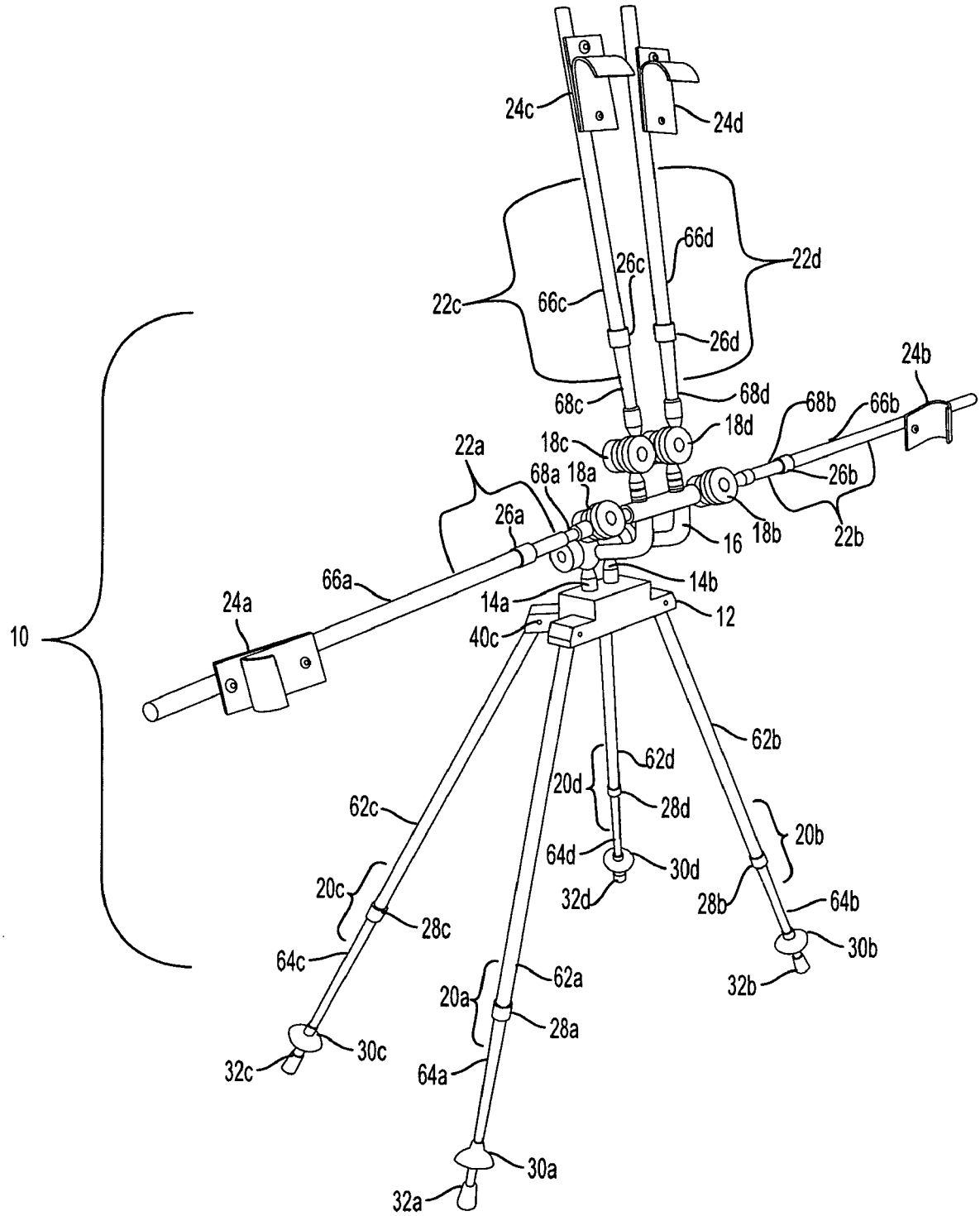
FIG. 1 is a perspective view of the multiple configuration portable easel.

In the preferred embodiment, feet 32 can include a steel or carbide spike for outdoors use with a protective, non-slip plastic or rubber foot covers for use inside as illustrated in FIG. 1. Feet 32 will be have a screw-on plastic or rubber dome baskets 30 similar to those used for hiking or skiing poles. These baskets 30 prevent legs 20 from sinking too far into soft earth or sand. It is understood that other mechanisms exist to serve the function of staking legs 20 into the ground to provide stability for outdoor painting such as leg spikes and could be used in some embodiments of the easel. Leveling glides may also be substituted for spikes for indoor use in other embodiments of the easel 10.

Description: Top Section of Easel

In the preferred embodiment, H-holder assembly 16 is made of three hollow pieces of metal tube welded together. A tube 52A and a second identical tube, 52B, are elbow-shaped and a tube 52C is straight. Tube 52C is joined to the proximal ends of tube 52A and tube 52B by welding and forms the shape of the letter H. Since H-holder 16 is made of three tubes, there are six openings into which adjustable clutches may be inserted. This is best visualized in FIG. 10D. It is understood that H-holder 16 could be formed from a single, solid member in this approximate shape as long as sufficient openings are formed to insert connecting adjustable clutches. In the preferred embodiment, connecting adjustable clutches 14 and 18 have two projecting ends which can be inserted into six H-holder ends to connect to K-base 12 and arms 22.

In the preferred embodiment, H-holder 16 serves two functions. The first, described above, is to connect to K-base 12 and form Hinge 14 through adjustable clutches 14A and 14B. Hinge 14 can be manipulated to position artwork from a flat, table top position to a vertical position to a tilted forward position. Adjustable clutches 14A and 14B permit this hinge mechanism 14 to be rigidly locked in place in the preferred embodiment. This mechanism is robust so that easel 10 holds larger and heavier artwork than other lightweight portable easels. Hinge mechanism 14 permits the elbow-curve of H-holder 16 to fold down over K-base 12 and legs 20 for compact storage as illustrated in FIG. 8A and FIG. 8B.

In the preferred embodiment, an additional opening, cutout 48, has been machined into K-base 12 to allow adjustable clutches 14A and 14B to be bolted securely through K-base without projecting out below the plane of K-base.

Adjustable clutches 14A and 14B are then inserted into distal ends of tube 52A and tubes 52B of H-holder 16, and fastened securely. Appropriate fasteners include but not limited to bolts, rivets, compression fasteners or welds. It is understood that there exist other mechanisms which could serve this hinge function, including but not limited to 3-way pan/tilt heads or ball heads used for adjustable camera tripods.

The second function of H-holder 16 is to hold the plurality of movable expandable arms 20 in such a manner that they can be adjusted to form a planar system for holding artwork or other objects. In the preferred embodiment, the ends of two additional adjustable clutches 18A and 18B are fastened in place on the left and right ends of transverse spanning member 52C of H-holder 16. The distal ends of adjustable clutches 18C and 18D are fastened securely in place on the proximal ends of tubes 52A and 52B of H-holder 16. The proximal ends of adjustable clutches 18 are attached to distal ends of the adjustable, telescoping arms 22. In the preferred embodiment, there are four arms 22 connected to H-holder 16 in openings 50 through four adjustable clutches 18. This is accomplished using a plurality of fasteners which connect the distal end of adjustable clutch 18 to arm 22 and the proximal end of adjustable clutch 18 to opening 50 in H-holder 16. This is best seen in FIG. 10C. Appropriate fasteners include but not limited to bolts, rivets, compression fasteners or welds. In the preferred embodiment, one adjustable clutch is fastened to each of the four ends of H-holder 16 in a plane best seen in FIG. 9. These four adjustable clutches 18 permit each of the four arms 22 to be individually moved in a 200 degree radius within this plane when the clutch is loosened, and then locked into place when the clutch is tightened.

Figure 3:
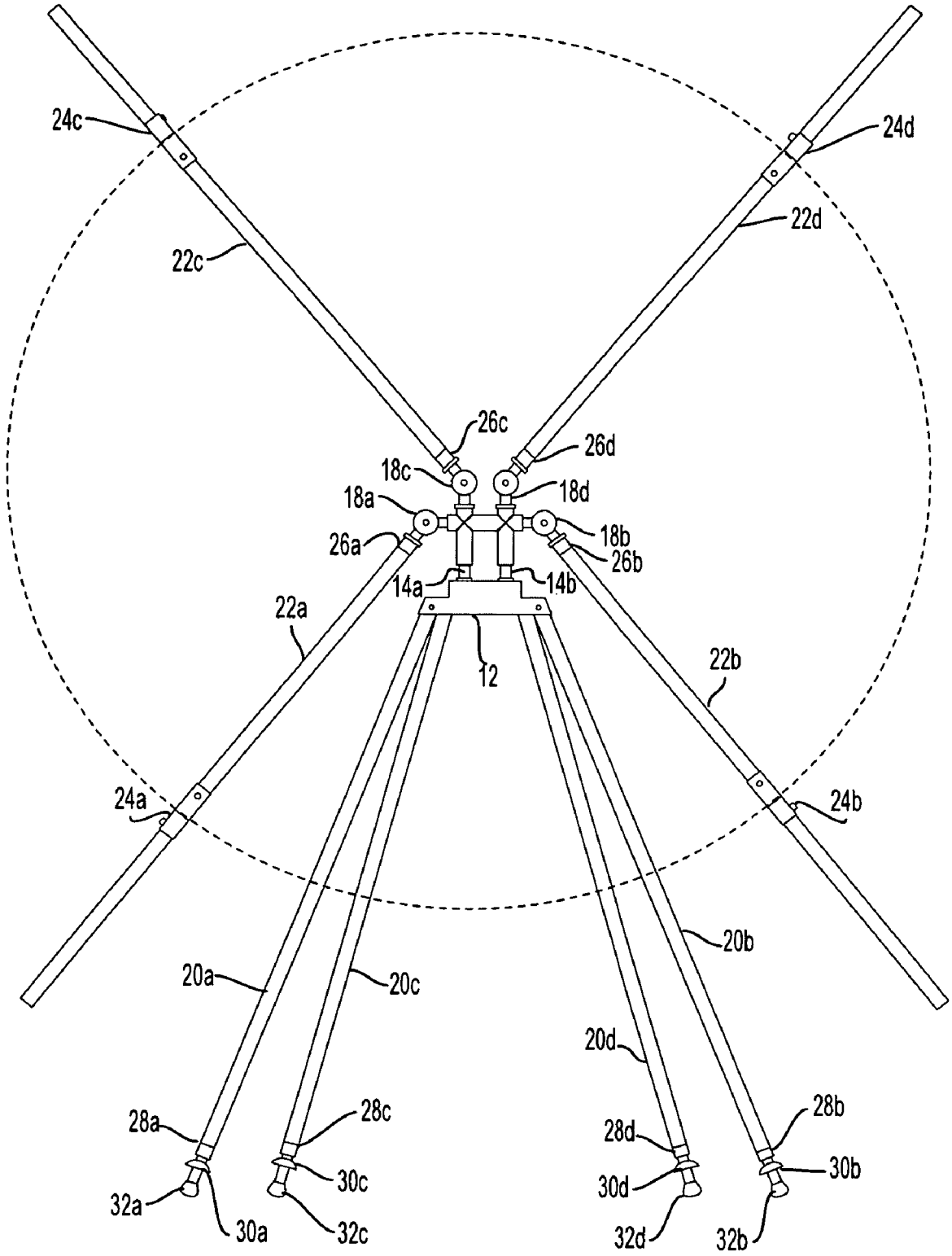
FIG. 3 is a front view of the partially extended easel holding a nonrectangular artwork.
Figure 4:
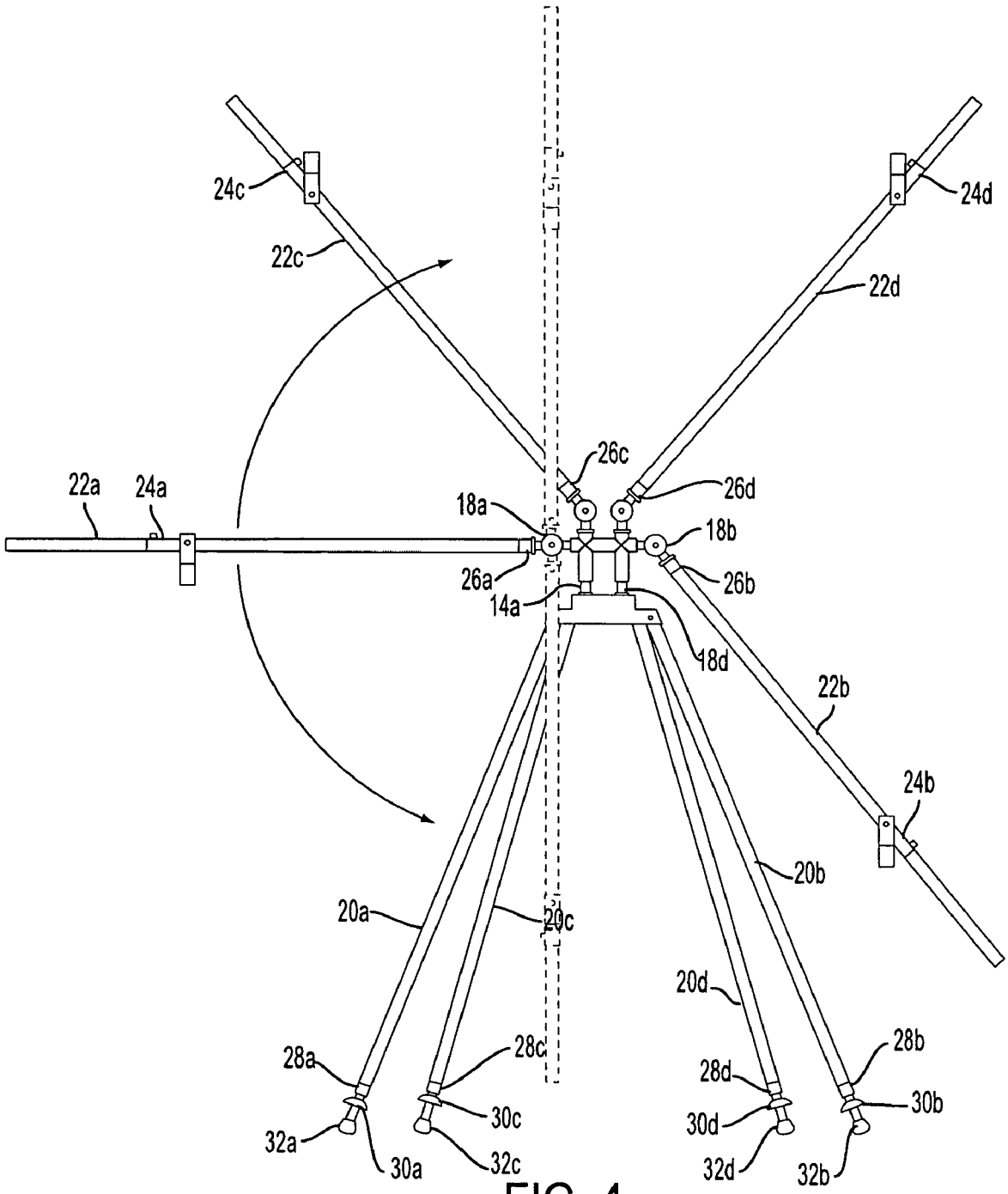
FIG. 4 is a front view of the easel showing how the lower arms are moved in relationship to the H-holder.
Figure 5:
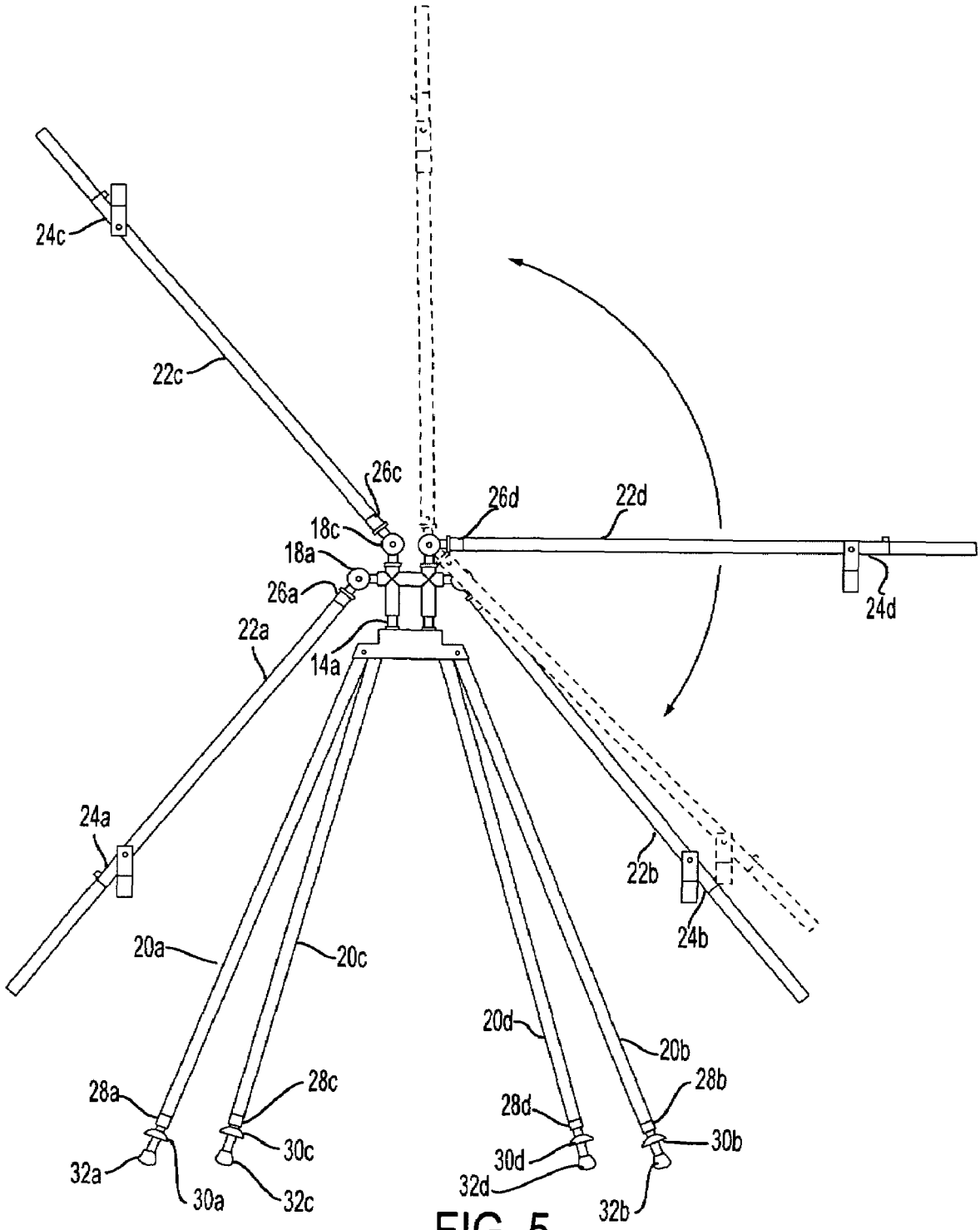
FIG. 5 is a front view of the easel showing how the upper arms are moved in relationship to the H-holder.
Figure 6:
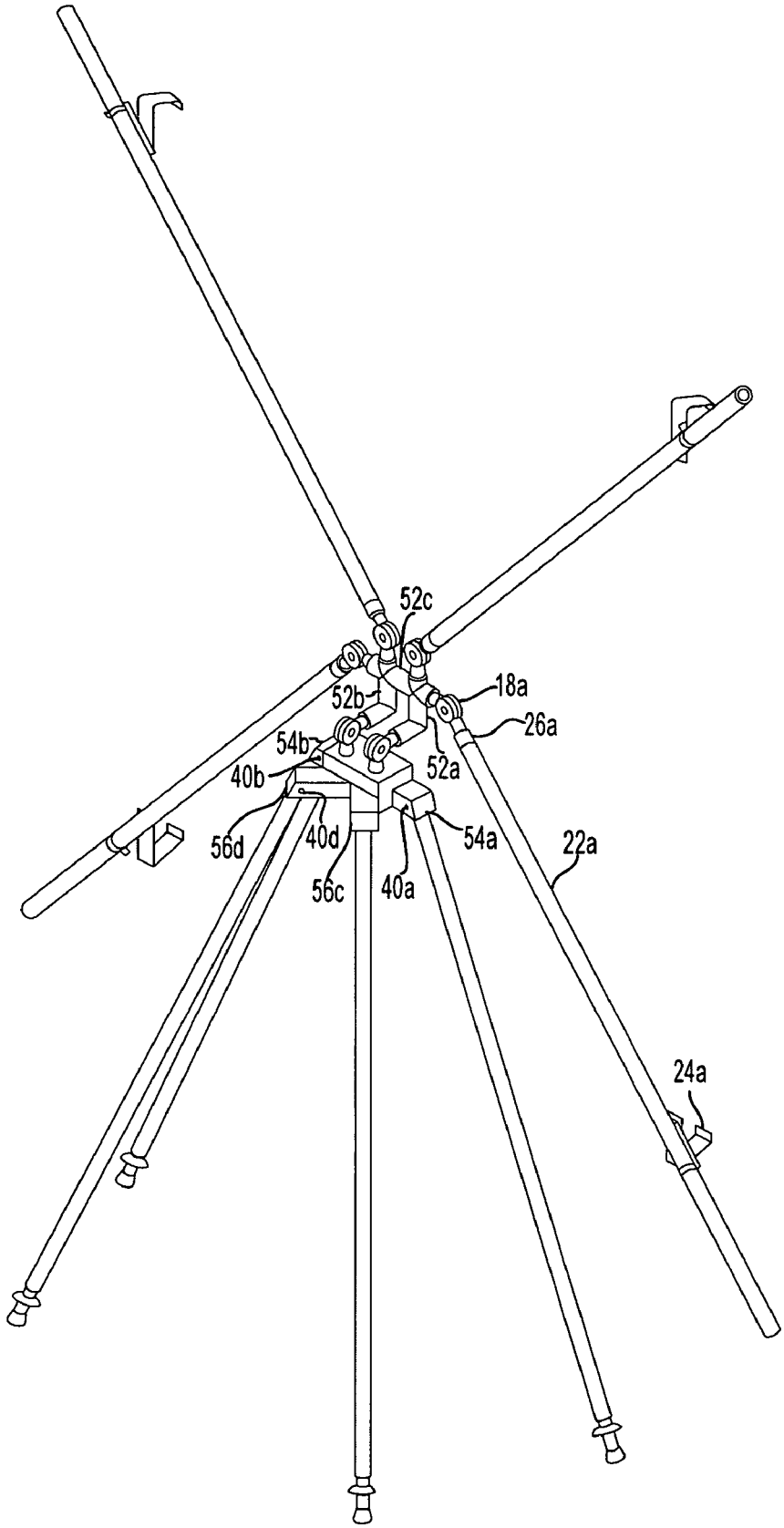
FIG. 6 is a perspective view from the back of the easel showing the relationship between the H-holder and the K-base, with the arms in a fully extended position.

When arms 22 are moved using adjustable clutches 18, these arms 22 form a flat surface upon which the artwork can be held in place using J-shaped clamping members 24. J-holder 24 can be selectively up and down along telescoping arms 22. The movement of lower arm 22A is illustrated in FIG. 4. The movement of upper arms 22D is illustrated in FIG. 5. FIG.2 shows adjustable arms 22 positioned to hold a rectangular canvas or other flat artwork. FIG. 3 shows adjustable arms 22 positioned to hold a non-rectangular flat artwork.

In the preferred embodiment, arms 22 can be used to position J-holder assembly 24 to grasp the artwork on its outside surface, enabling any reasonable flat artwork to be positioned by hinge 14 at any desired angle, including parallel to the ground. It would be readily evident to one skilled in the art that the use of other locking mechanisms than adjustable clutches 18 would also permit the variety of orientations of arms 22 and would be equally appropriate. Artists position artwork on easels in a range of positions to improve application of art materials without running or smudging them. Artists position artwork in a range of positions to observe the artwork from a variety of angles during the process of creation of the artwork.

In accordance with one aspect of this invention, adjustable clutches 18 enable arms 22 to swing out to hold nonrectangular paintings and to position rectangular paintings on the diagonal. In conjunction with hinge function 14 of H-holder 16, adjustable arms 22 can be positioned to hold the artwork in an ergonomic position, so that fatigue, strain and injury from repetitive motion at an uncomfortable height or angle can be minimized. Adjustable arms 22 provide an increased display surface where up to four artworks can be accessed in a variety of orientations in the X, Y and Z planes. In terms of three-dimensional motion, the artwork can be adjusted to have pitch or roll, but not yaw.

In the preferred embodiment, each of arms 22 comprises extruded telescoping tubing, cut to desired lengths and attached with rivets to adjustable clutches 18. Other attachment mechanisms, as would be evident to one skilled in the art, including screw, blot, ball and socket, ball and cuff mechanisms and pressure lock joint systems would be appropriate to secure arm 22 to adjustable clutch 18.

In the preferred embodiment, each arm 22 is individually adjustable in length. Each arm 22 comprises a first extension 68 and a second extension 66 slidably connected to one another. Second extension 66 has at least a portion thereof slidably received in the open-faced channel of first extension 68. Second extension 66 is secured in position with a clamp 26 extending from second extension 66 through a slot of first extension 68. In the preferred embodiment, both the legs and arms are made of metal alloy. It would be readily evident to one skilled in the art that other materials would include aluminum, steel, titanium or equivalent materials.

In the preferred embodiment, the maximum telescoping length of arms 22 is 36 inches. In the preferred embodiment, the maximum diameter of the arm tubing is 1 inches. The large extension of arms 22 permits easel 10 to expand to hold a larger size range of canvases or artworks than other collapsible portable easels. Artwork ranging in size from six by four and one half inches to eight feet by eight feet can be held in position for painting or display. Adjustable arms 22 can each hold an individual canvas, allowing an artist to create or display a related group of paintings such as a diptych or triptych. Adjustable arms 22 can be positioned ergonomically so that fatigue, strain, and injury from repetitive movement at an uncomfortable angle or height can be minimized.

Description of Mechanism of Holding Paintings on the Easel

In the preferred embodiment, artworks are held in position on the plane created by adjusting arms 22 on easel 10 through attaching the artwork using J-holder assemblies 24, one for each arm 22. J-shaped assembly 24 is comprised of three members joined together, best illustrated in FIG. 8B. J-shaped piece is 40C. It is understood however, that this member may have another shape or profile that can achieve the same result. A flat piece of metal 34C is attached parallel to the back of J-member 40C by a Rivet 38 or other appropriate fastener that will permit J-member 40C to be moved in 360 degrees of rotation. Flat piece of metal 34C is attached horizontally to J-member 40C by a weld to an annular clamp 36 that hinges at one side and is fastened by an adjustable knob. This allows J-holder assembly 24 to be adjusted by moving it up and down arms 22. Positioning J-holder assembly 24 along adjustable arm 22 enables easel 10 to hold varying sizes and shapes of artwork.

Each J-holder assembly 24 can be placed along any position on the widest diameter tubing of telescoping arm 22 using adjustable annular clamp 26. This comprises a mechanism of enabling easel 10 to accommodate a range of artwork dimensions. J-holder assembly 24 is designed to stably hold the artwork close to supporting arm 22 by directing the force of the artwork to press J-shaped member 40C against flat rectangular member 34C. J-holder assembly 24 can be covered by a plastic sleeve, which provides a flat, grooved surface to hold thinner boards such as Masonite boards. It is readily evident to one skilled in the art that other adjustable holder and clamp systems may also be used to affix artworks to the easel. J holder assembly 24 in this embodiment works most effectively with artworks with canvases attached to stretchers. In this embodiment, the clamp and friction stabilize the heavy artwork on the light weight easel.

Conclusions, Ramifications and Scope

In accordance with the invention, support legs 20 are pivotally connected and moveable between folded positions and extended, supportive positions. Folded easel 10 then fits within a storage bag. It is collapsible without disassembly of arms 22, legs 20 or painting supports from K-base 12 and H-holder 16.

This comprises a mechanism allowing arms 22 to be moved into a vertical side by side position in relation to legs 20, enabling easel 10 to be folded into a compact and easily transportable configuration. In the preferred embodiment, the minimum width of easel 10 in its most compact configuration is six inches at the top of the easel 10 and ten inches at the base of easel 10. In the preferred embodiment, the minimum height of easel 10 in its most compact configuration is 42.5 inches.

Preferred embodiments of the present invention have been disclosed. A person of ordinary skill in the art would realize, however, that certain modifications would come within the teachings of this invention. Therefore, the following claims should be studied to determine the true scope and content of the invention.

I claim:

1. An easel comprising:

a base;

at least four legs;

means for attaching said legs to said base and allowing said legs to pivot to an open or closed position;

means for adjusting and locking said legs at varying lengths;

an arm holder comprising:

a plurality of members with an elbow-shaped bend having a plurality of openings in the distal end and a plurality of openings in the proximal end, wherein the openings in the proximal end are at right angles to one another;

said arm holder attached to said base via the plurality of distal openings in said arm holder; and means for attaching said base to said arm holder, wherein said arm holder may be adjusted from a folded storage position to a range of positions, and wherein said arm holder may be locked in place;

a plurality of adjustable arms; said arm holder attached to said arm via the plurality of proximal openings;

means for attaching each one of said arms to said arm holder allowing said arms to freely pivot in a plane until locked in position;

means for adjusting and locking said arms at varying lengths;

a plurality of artwork holders movably attached to each one of said arms; and means for adjusting artwork holders allowing objects held by the holders to be adjusted along the arms.

2. The easel of claim 1, wherein each of said legs are pivotally attached within an individual obtuse angled cutout so that each leg touches the base within said obtuse angled cutout when the leg is held in the open position.

3. The easel of claim 2, wherein said base having a K-shape with a straight edge of the "K" in front and the V-shaped portion of the "K" projecting toward the back; and said legs fastened to said base obtuse angled cutouts by means which permit said legs to pivot in so that the legs spread out from the base at an obtuse angle and are held in place by the weight of the object held by the easel.

4. The easel of claim 3, wherein said legs further comprises:

a plurality of front legs pivotally fastened in an obtuse angled cutout on the straight of said K-shaped base; and a plurality of rear legs pivotally fastened at mirror image, more obtusely angled cutouts in the V-shaped portion of the K-shaped base so that the base can tilt in to the rear of the easel for stability.

5. The easel of claim 2, wherein said arm holder comprises a pair of elbow-shaped tubes joined transversely by a straight tube; and said arm holder comprises at least six openings into which an adjustable locking mechanism may be inserted.

6. The easel of claim 1, wherein each one of the plurality of members further comprises a pair of elbow-shaped bends joined transversely by a straight tube; and said arm holder comprises at least six openings into which an adjustable locking mechanism may be inserted.

7. The easel of claim 6, wherein each one of the plurality of artwork holders further comprises:

an assembly of a bent piece of material having a J-shape;

a blank piece of material in a shape suitable for forming a tight junction with the arm of the easel; a clamp which fits over the arm of the easel and can be adjusted;

each one of said artwork holders being constructed by sandwiching the blank piece of material between the J-shaped blank and the adjustable clamp a fastener that will permit these layers to be moved in 360 degrees of rotation relative to one another, each one of said artwork holders being placed along any position on the tubing of arm of the easel so that the easel stably holds a range of artwork dimensions and shapes.

8. The easel of claim 1, wherein the base in which each one of said legs is pivotally attached within an individual obtuse angled cutout so that each leg touches the base within said obtuse angled cutout when the leg is held in the open position.

9. The easel of claim 8, wherein the base having a K-shape with a straight edge of the "K" in front and the V-shaped portion of the "K" projecting back.

10. The easel of claim 9, wherein said legs further comprise:

a plurality of front legs pivotally fastened in an obtuse angled cutout on the straight edge of said K-shaped base; and a plurality of rear legs pivotally fastened at obtuse angled cutouts in the V-shaped portion of said K-shaped base so that the base can tilt in to the rear of the easel for stability.

11. The easel of claim 1, further comprising:

a plurality of steel or carbide spikes attached to the lower ends of the legs to anchor the easel into the ground a plurality of protective, non-slip, leveling glide, foot covers which cover said spikes; and a plurality of dome baskets attached to the lower ends of said legs to prevent the legs from sinking too far into soft earth or sand.

12. The easel of claim 11, wherein each one of the plurality of artwork holders comprises:

an assembly of a bent piece of J-shaped material;

a blank piece of material in a shape suitable for forming a tight junction with the arm of the easel; a clamp which fits over the arm of the easel and can be adjusted;

each one of the plurality of artwork holders being constructed by sandwiching the blank piece of material between the J-shaped blank and the adjustable clamp allowing these layers to be moved in 360 degrees of rotation relative to one another; and each one of the plurality of artwork holders being placed along any position on the tubing of arm of the easel so that the easel stably holds a range of artwork dimensions and shapes.

13. An easel comprising:

a base;

at least four legs;

each one of said legs pivotally attached within an individual obtuse-angled cutout wherein each leg touches the base within said obtuse-angled cutout when the leg is held in the open position;

means for attaching said legs to said base and allowing said legs to pivot to an open or closed position;

means for adjusting and locking said legs at varying lengths;

an arm holder comprising:

a plurality of members with an elbow-shaped bend having a plurality of openings in the distal end and a plurality of openings in the proximal end, wherein the openings in the proximal end are at right angles to one another;

said arm holder attached to said base via the plurality of distal openings in said arm holder; and means for attaching said base to said arm holder, wherein said arm holder may be adjusted from a folded storage position to a range of positions, and wherein said arm holder may be locked in place;

a plurality of adjustable arms; said arm holder attached to said arms via the plurality of proximal openings;

means for attaching each one of said arms to said arm holder allowing said arms to freely pivot in a plane until locked in position;

means for adjusting and locking said arms at varying lengths;

a plurality of artwork holders movably attached to each one of said arms; and means for adjusting artwork holders allowing objects held by the holders to be adjusted along the arms.

14. An easel comprising:

a base;

at least four legs;

each one of said legs pivotally attached within an individual obtuse-angled cutout wherein each leg touches the base within said obtuse angled cutout when the leg is held in the open position;

means for attaching said legs to said base and allowing said legs to pivot to an open or closed position;

means for adjusting and locking said legs at varying lengths;

an arm holder comprising:

a pair of elbow-shaped tubes transversely coupled by a straight tube;

at least six openings, wherein an adjustable locking mechanism may be selectively inserted into one of the at least six openings, said arm holder attached to said base via one of the at least six openings having said adjustable locking mechanisms;

means for attaching said base to said arm holder, wherein said arm holder may be adjusted from a folded storage position to a range of positions, and wherein said arm holder may be locked in place;

a plurality of adjustable arms; said arm holder attached to said arms via one of the at least six openings having said adjustable locking mechanisms;

means for attaching each one of said arms to said arm holder allowing said arms to freely pivot in a plane until locked in position;

means for adjusting and locking said arms at varying lengths;

a plurality of artwork holders movably attached to each one of said arms; and means for adjusting artwork holders allowing objects held by the holders to be adjusted along the arms.

* * * * *